US005078849A

United States Patent [19]

Sagbraten

[11] Patent Number: 5,078,849

[45] Date of Patent: Jan. 7, 1992

[54] CRUST BREAKER DEVICE FOR ALUMINUM ELECTROLYSIS CELLS

[75] Inventor: Alf Sagbraten, Ovre Ardal, Norway

[73] Assignee: Norsk Hydro a.s., Oslo, Norway

[21] Appl. No.: 587,762

[22] Filed: Sep. 26, 1990

[30] Foreign Application Priority Data

Sep. 27, 1989 [NO] Norway ..... 893854

[51] Int. Cl.[5] ..... C25C 3/14

[52] U.S. Cl. ..... 204/245; 204/179

[58] Field of Search ..... 204/245, 279, 243 R M, 204/244, 246, 247

[56] References Cited

U.S. PATENT DOCUMENTS 3,216,918 11/1965 Duclaux ..... 204/245
4,377,452 3/1983 Casdas ..... 204/245 X
4,617,100 10/1986 Broughton ..... 204/245
4,654,963 4/1987 Sugalski ..... 429/164 X
4,956,054 9/1990 Dronnesund et al. ..... 204/245 X

*Primary Examiner*—Donald R. Valentine
*Attorney, Agent, or Firm*—Wenderoth, Lind & Ponack

[57] ABSTRACT

A crust breaker device used to break crusts of aluminum electrolysis cells includes a member to be driven for instance a piston/cylinder device with a piston rod in axial movement, essentially in a vertical direction. To a lower part of the member is connected a cutter bar or crow bar which is designed to be moved through the crust and make a hole therein. The cutter bar is connected to, but electrically isolated from the member by means of a fire proof material having insulation properties and that is cast and then hardened.

32 Claims, 2 Drawing Sheets

CRUST BREAKER DEVICE FOR ALUMINUM ELECTROLYSIS CELLS

BACKGROUND OF THE INVENTION

The present invention relates to a crust breaker device for use to break crust in aluminum electrolysis cells, and including a driven unit with a bar, for instance a piston/ cylinder device with a piston rod, which is designed for axial movement basically in a vertical direction and a cutter bar or crow bar connected to a longer part of the bar and designed to be moved through the crust and to make a hole therein.

When producing aluminum with salt melt electrolysis, point feeders are used to supply additives such as aluminum oxide to the electrolysis cells. The additives are supplied batchwise to one or more points in the electrolysis cells by means of sophisticated supply equipment. Since the electrolysis bath of the cell is covered with a crust, crust breakers of the above type are provided to make holes in the crust to form the feeding points immediately before the dose of additives is supplied to the electrolytic bath.

The crust breakers usually are connected to the anode construction of the electrolysis cells, and to avoid short circuiting when the cutter bar is moved through the crust and into the electrolytic bath, the crust cutters are electrically isolated from the anode at connection points of each crust breaker (at least two points). However, to isolate the crust breakers from the anode is a cumbersome and time consuming task, since specially designed isolation structures, such as casings and discs for screws and nuts, have to be used, thereby demanding precise positioning and mounting. Besides, the isolation structure as such is expensive, and the possibility that the isolation structure will be damaged or defective is relatively large, whereby more or less current is led through the crust breaker, resulting in damage to the crust breaker and current losses. An isolation structure between the crust breaker and the anode according to known principles therefore represents an expensive solution.

SUMMARY OF THE INVENTION

The present invention provides a crust breaker which is not encumbered with the above disadvantages, i.e. which has good electric isolation properties,
uses inexpensive structure to achieve isolation,
can be easily mounted,
is safe and
is simpler than known solutions.

This is achieved by means of a crust breaker device including a cutter bar connected with, but electrically isolated from a bar by means of an electrically insulating or nonconducting connection.

BRIEF DESCRIPTION OF THE DRAWINGS

The invention will not be further described by way of example only and with reference to the drawings, in which.

DETAILED ION OF THE INVENTION

Figure 1A:
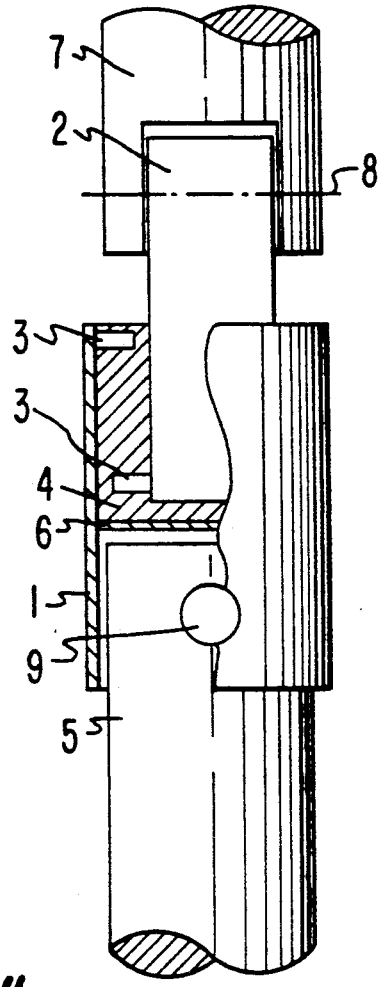
FIG. 1*a* is a schematic view, partially in section, of a crust cutter according to the invention.
Figure 1B:
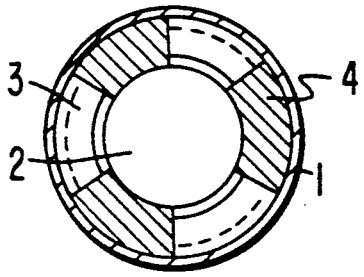
FIG. 1*b* is a transverse sectional view of the crust cutter shown in FIG. 1*a*.

The crust breaker device shown in FIGS. 1*a* and 1*b* includes a mechanical, electrically insulating or non-conductive connection between a member such as a bar 7 of a driven unit, for instance a piston rod of a piston/-cylinder device, and a cutter bar or a crow bar 5 on a crust breaker which is used in electrolysis cells producing aluminum (only the upper part of the cutter bar and the lower part of the rod are shown. One, two or several crust cutters may be provided for each electrolysis cell, and their object is to make a hole in the crust covering the electrolysis cell prior to the supply of oxide or other additives to the bath of the cell (the equipment for supply of oxide is not shown).

In the example shown in FIGS. 1*a* and 1*b*, the mechanical, but electrically insulating or non-conductive connection includes a shell-like bushing or outer skirt 1 which is provided with a partition wall or a plate 6. The plate 6 divides the bushing 1 into an upper, upwardly open space and a lower, downwardly open space. A pin or rod 2 protrudes partly down into the upper space which is filled with a fire proof material 4 with electrical insulation properties. Material 4 may be cast into the space hardened therein. To improve the connection, both the pin 2 and the bushing 1 are provided with protruding projections 3 or the like that essentially act as anchors in hardened material 4.

The upper end of pin 2 is connected to the bar 7 by means of a bolt connection. Thus, the pin has a smaller diameter than the bar 7, fits into a bore in the bar and is securely attached thereto by means of a through-going bolt 8 (indicated by a dotted line).

The cutter bar 5 on the other hand is connected at its upper end to bushing 1 by extending into the downwardly open space in the bushing and by being securely attached thereto by means of another through-going bolt 9.

By using pin 2 and simple bolt connections between the cutter bar 5 and the bushing 1 and between the pin 2 and the bar 7, important advantages are achieved with respect to the maintenance of the crust cutter. Thus, the mechanical electrically insulating or non-conducting connection represents a separate unit which in a simple way can be disconnected from the cutter bar 5 and bar 7 by pulling out the bolts 9 and 8, respectively.

Figure 2:
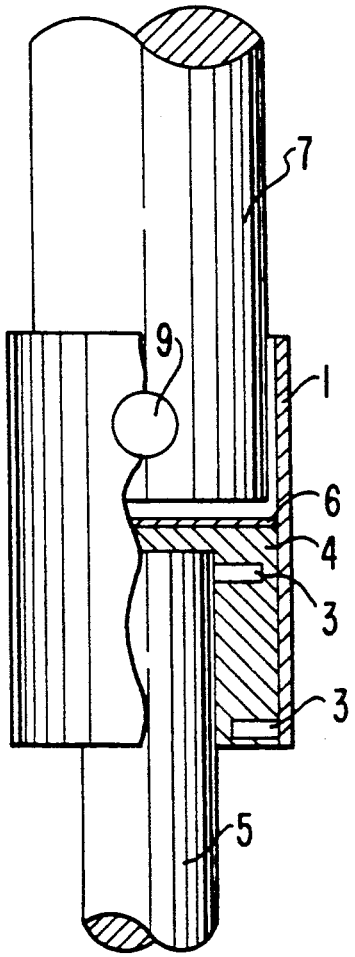
FIG. 2 is a view similar to FIG. 1*a* of an alternative embodiment of the device according to the invention.

In FIG. 2 is shown an example of an alternative embodiment of the invention which is somewhat less expensive to produce, but which with regard to maintenance may be somewhat more expensive. Here one can, instead of using a pin 2, embed the upper part of the cutter bar 5 directly in the isolating material 4. Thus, when the cutter bar 5 is worn out and has to be exchanged, the electric insulating or non-conducting connection also has to be exchanged.

With the embodiment of the invention according to FIG. 2 the electrically insulating or non-conducting connection between the bar 7 and the cutter bar 5 is "upside down" compared to the embodiment of FIGS. 1*a*, 1*b*. Thus, the bar 7 is connected to the bushing 1 in a manner similar to that of the connection of cutter bar 5 to the bushing 1 in FIGS. 1*a*, 1*b*.

As can be readily understood, the invention may be modified by varying the manner of attachment between the electrically insulating or non-conducting connection and the bar and between the electrically insulating or non-conducting connection and the cutter bar. For instance, instead of using locking bolts 8, 9, it is possible to use flange connections with screws and nuts or some form of threaded connections.

Also, with the regard to the shape of the crust cutter device, instead of being round as shown in the drawings, it may have other cross sections, for instance a square cross section. Further, the projections 3 may be of other designs.

I claim:

1. A crust breaker device to be used to break the crust in an aluminum electrolysis cell, said device comprising:

a member adapted to be driven in substantially a vertical axial direction;

a cutter bar adapted to be moved by said member to form a hole in a crust; and means for mechanically connecting said cutter bar to a lower end of said member while providing electrical insulation therebetween, said means comprising a shell having an interior and a partition extending across said interior and dividing said shell into upper and lower portions and defining at least one interior shell space among an upper, upwardly open space in said upper shell portion and a lower, downwardly open space in said lower shell portion, one component among said member or said cutter bar or a pin element extending from said member or from said cutter bar projecting into said at least one interior shell space, a fire proof material with electrical insulation properties cast into said at least one interior shell space and hardened therein to secure said one component to the respective upper or lower shell portion, and the other of said member or said cutter bar being securely attached directly to the other of said upper and lower shell portions.

2. A device as claimed in claim 1, wherein said partition defines within said shell both upper, upwardly open and lower, downwardly open spaces.

3. A device as claimed in claim 2, wherein said one component comprises said pin element.

4. A device as claimed in claim 3, wherein said pin element fits within an axial bore in one of said member or said cutter bar.

5. A device as claimed in claim 4, wherein said pin element has a diameter less than that of said one of said member or said cutter bar.

6. A device as claimed in claim 3, wherein said pin element is detachably connected by connecting means to said one of said member or said cutter bar.

7. A device as claimed in claim 6, wherein said connecting means comprises a locking bolt extending through said pin element and said one of said member or said cutter bar.

8. A device as claimed in claim 6, wherein said pin connecting means comprises a pair of attached flanges of said pin element and said one of said member or said cutter bar.

9. A device as claimed in claim 6, wherein said pin connecting means comprises a threaded joint between said pin element and said one of said member or said cutter bar.

10. A device as claimed in claim 3, wherein said pin element has a first end connected to one of said member or said cutter bar and a second end projecting into one of said spaces.

11. A device as claimed in claim 10, wherein said second end of said pin element has protruding therefrom projections embedded in said hardened fire proof material.

12. A device as claimed in claim 11, wherein said shell has interior projections protruding inwardly therefrom and embedded in said hardened fire proof material.

13. A device as claimed in claim 10, wherein said first end of said pin element is connected to said member, and said second end of said pin member projects into said upper, upwardly open space and is embedded in said hardened fire proof material therein.

14. A device as claimed in claim 10, wherein said first end of said pin element is connected to said cutter bar, and said second end of said pin element projects into said lower, downwardly open space and is embedded in said hardened fire proof material therein.

15. A device as claimed in claim 2, wherein said one component comprises said member projecting into said upper, upwardly open space and embedded in said hardened fire proof material therein.

16. A device as claimed in claim 15, wherein said member has protruding therefrom projections embedded in said hardened fire proof material.

17. A device as claimed in claim 16, wherein said shell has interior projections protruding inwardly therefrom and embedded in said hardened fire proof material.

18. A device as claimed in claim 15, wherein said cutter bar has an upper end projecting into said lower, downwardly open space and securely attached to said lower shell portion by connecting means.

19. A device as claimed in claim 18, wherein said connecting means comprises a locking bolt extending through said lower shell portion and said upper end of said cutter bar.

20. A device as claimed in claim 2, wherein said one component comprises said cutter bar projecting into said lower, downwardly open space and embedded in said hardened fire proof material therein.

21. A device as claimed in claim 20, wherein said cutter bar has protruding therefrom projections embedded in said hardened fire proof material.

22. A device as claimed in claim 21, wherein said shell has interior projections protruding inwardly therefrom and embedded in said hardened fire proof material.

23. A device as claimed in claim 20, wherein said member has a lower end projecting into said upper upwardly open space and securely attached to said upper shell portion by connecting means.

24. A device as claimed in claim 23, wherein said connecting means comprises a locking bolt extending through said upper shell portion and said lower end of said member.

25. A device as claimed in claim 1, wherein said cutter bar is securely attached to said lower shell portion by connecting means.

26. A device as claimed in claim 25, wherein said connecting means comprises a locking bolt extending through said lower shell portion and said cutter bar.

27. A device as claimed in claim 25, wherein said connecting means comprises a pair of attached flanges of said lower shell portion and said cutter bar.

28. A device as claimed in claim 25, wherein said connecting means comprises a threaded joint between said lower shell portion and said cutter bar.

29. A device as claimed in claim 1, wherein said member is securely attached to said upper shell portion by connecting means.

30. A device as claimed in claim 29, wherein said connecting means comprises a locking bolt extending through said upper shell portion and said member.

31. A device as claimed in claim 29, wherein said connecting means comprises a pair of attached flanges of said upper shell portion and said member.

32. A device as claimed in claim 29, wherein said connecting means comprises a threaded joint between said upper shell portion and said member.

* * * * *